US008474887B2

(12) United States Patent
Suzuki et al.

(10) Patent No.: US 8,474,887 B2
(45) **Date of Patent: *Jul. 2, 2013**

(54) DOOR OPENING AND CLOSING APPARATUS FOR VEHICLE

(75) Inventors: Shintaro Suzuki, Kasugai (JP); Takeshi Nishikibe, Anjo (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 968 days.

This patent is subject to a terminal disclaimer.

(21) Appl. No.: 12/343,919

(22) Filed: Dec. 24, 2008

(65) Prior Publication Data

US 2009/0165386 A1 Jul. 2, 2009

(30) Foreign Application Priority Data

Dec. 27, 2007 (JP) ..... 2007-336289

(51) Int. Cl.
*E05C 3/06* (2006.01)

(52) U.S. Cl.
USPC ..... 292/201; 292/216

(58) Field of Classification Search
CPC ... E05B 81/14; E05B 85/26; E05B 1/06; E05B 47/0012; G07C 9/00912; E05F 15/127
USPC ..... 292/201, 216, 280, DIG. 23; 70/237, 70/267–270, 278, 279; 49/339, 440, 341, 49/342, 394
See application file for complete search history.

(56) References Cited

U.S. PATENT DOCUMENTS 4,451,887 A * 5/1984 Harada et al. ..... 701/49
4,749,873 A * 6/1988 Mutoh et al. ..... 307/10.2
4,762,348 A * 8/1988 Matsumoto ..... 292/201
5,520,425 A * 5/1996 Dowling ..... 292/201
5,938,251 A * 8/1999 Watanabe ..... 292/201
5,947,536 A * 9/1999 Mizuki et al. ..... 292/201

(Continued)

FOREIGN PATENT DOCUMENTS

DE 10 2004 008001 A1 11/2004
JP 62-197583 A 9/1987
JP 2007-002589 A 1/2007
WO WO 02/087912 A 11/2002

OTHER PUBLICATIONS

European Search Report dated Jun. 19, 2009 in corresponding European Application No. 08172079.9.

*Primary Examiner* — Thomas Beach
*Assistant Examiner* — Nathan Cumar
(74) *Attorney, Agent, or Firm* — Buchanan Ingersoll & Rooney PC

(57) ABSTRACT

A door opening and closing apparatus for a vehicle includes a displacement body operating a latch and being displaced within a moving region including a closing region, a releasing region and a neutral region positioned between the closing region and the releasing region, the displacement body displacing by an actuator, a control unit controlling the actuator for selectively engaging and disengaging the latch and a striker, a first detection portion outputting a first detection signal changed when the displacement body passes through a first border portion of the neutral region closer to the closing region, and a second detection portion outputting a second detection signal changed when the displacement body passes through a second border portion of the neutral region closer to the releasing region. The control unit controls a moving position of the displacement body based on the first detection signal and the second detection signal.

21 Claims, 9 Drawing Sheets

U.S. PATENT DOCUMENTS

| | | | | |
|---|---|---|---|---|
| 5,951,069 | A * | 9/1999 | Kobayashi et al. | 292/201 |
| 6,053,542 | A * | 4/2000 | Ostrowski et al. | 292/201 |
| 6,168,216 | B1 * | 1/2001 | Nakajima et al. | 292/201 |
| 6,382,686 | B1 * | 5/2002 | Ishigaki et al. | 292/201 |
| 6,386,599 | B1 * | 5/2002 | Chevalier | 292/201 |
| 6,422,615 | B1 * | 7/2002 | Roos et al. | 292/216 |
| 6,437,531 | B1 * | 8/2002 | Kawamura | 318/445 |
| 6,540,271 | B1 * | 4/2003 | Kalsi | 292/216 |
| 6,542,071 | B1 * | 4/2003 | Ohtsubo et al. | 340/426.28 |
| 6,719,356 | B2 * | 4/2004 | Cleland et al. | 296/146.8 |
| 6,848,727 | B1 * | 2/2005 | Cetnar et al. | 292/201 |
| 6,964,438 | B2 * | 11/2005 | Koike et al. | 292/201 |
| 6,974,165 | B2 * | 12/2005 | Koike et al. | 292/216 |
| 2004/0227356 | A1 | 11/2004 | Koike et al. | |
| 2005/0167991 | A1 | 8/2005 | Yoneyama | |

* cited by examiner

First neutral position
Second neutral position
40
61
62
63
63a
51(50)
41
41a
411
412
413
421
42
42a
2
81
82
83
84
85

First neutral position
Second neutral position
40
61
62
63
63a
52(50)
41
41a
411
412
413
421
42
42a
2
81
82
83
84
85

DOOR OPENING AND CLOSING APPARATUS FOR VEHICLE

CROSS REFERENCE TO RELATED APPLICATIONS

This application is based on and claims priority under 35 U.S.C. §119 to Japanese Patent Application 2007-336289, filed on Dec. 27, 2007 the entire contents of which is incorporated herein by reference.

FIELD OF THE INVENTION

The present invention relates to a door opening and closing apparatus for a vehicle.

BACKGROUND

A known door lock operation apparatus for a vehicle which performs a locking operation by rotating an output shaft of an actuator in a normal direction and an unlocking operation by rotating the output shaft in a reverse direction is disclosed in JP62-197583A. A known door closing apparatus for a vehicle is disclosed in JP2007-2589A, which performs a closing operation, capturing a striker by rotating a latch by displacing, in one direction, a driven gear serving as a displacement body which receives a motor driven force and is rotatable in normal and reverse directions. The door closing apparatus further performs a releasing operation in which a pawl is rotated to disengage the latch and the pawl by displacing the driven gear in the other direction.

The known apparatuses explained above includes a releasing function which disengages the latch and the striker by displacing the displacement body such as a sector gear which receives the motor driven force in a releasing direction with reference to a neutral region and a closing function in which the latch captures the striker by actuating the displacement body in a closing direction with reference to the neutral region. In those circumstances, in case of displacing the displacement body to the neutral region by the motor driven force after executing the releasing function or the closing function, a neutral detection portion such as a switch, in order to control for stopping the motor, is required. However, in the event that the neutral detection portion is in failure, there is a possibility that the displacement body may be moved to a terminal end of the displacement. In other words, the movement of the displacement body is not stopped after the execution of the closing operation, and starting the releasing operation to re-unlock the once locked door. Further, there is also a possibility that the movement of the displacement body is not stopped within the neutral region after the execution of the releasing operation, and starting the closing operation thus to re-lock the once unlocked door.

A need thus exists for a door opening and closing apparatus for a vehicle which is not susceptible to the drawback mentioned above.

SUMMARY OF THE INVENTION

In light of the foregoing, the present invention provides a door opening and closing apparatus for a vehicle, which includes a latch configured to engage with and disengaged from a striker, a displacement body operating the latch via a latch operation mechanism and being displaced within a moving region including a closing region in which the latch is engaged with the striker, a releasing region in which the latch is disengaged from the striker and a neutral region positioned between the closing region and the releasing region, the displacement body displacing by means of a drive force of an actuator for selectively engaging and disengaging the latch and the striker, a first detection portion outputting a first detection signal changed when the displacement body passes through a first border portion of the neutral region closer to the closing region, and a second detection portion outputting a second detection signal changed when the displacement body passes through a second border portion of the neutral region closer to the releasing region, and a control unit connected to the first detection portion and the second detection portion, and controls a moving position of the displacement body based on the first detection signal and the second detection signal.

BRIEF DESCRIPTION OF THE DRAWINGS

The foregoing and additional features and characteristics of the present invention will become more apparent from the following detailed description considered with the reference to the accompanying drawings, wherein.

DETAILED DESCRIPTION

Figure 1:
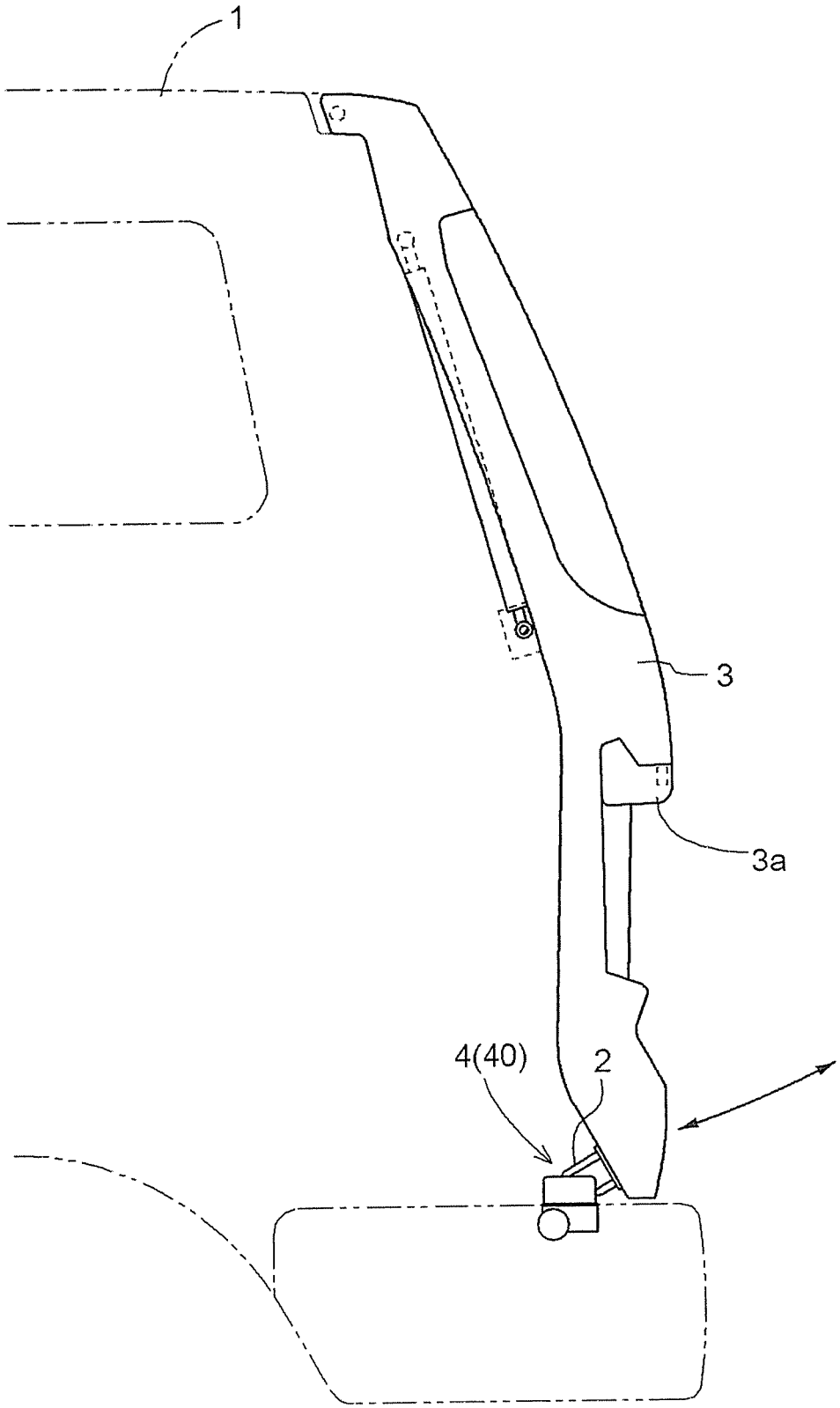
FIG. 1 is a lateral view of a rear portion of a vehicle which includes a door opening and closing apparatus for a vehicle according to an embodiment of the present invention.
Figure 2:
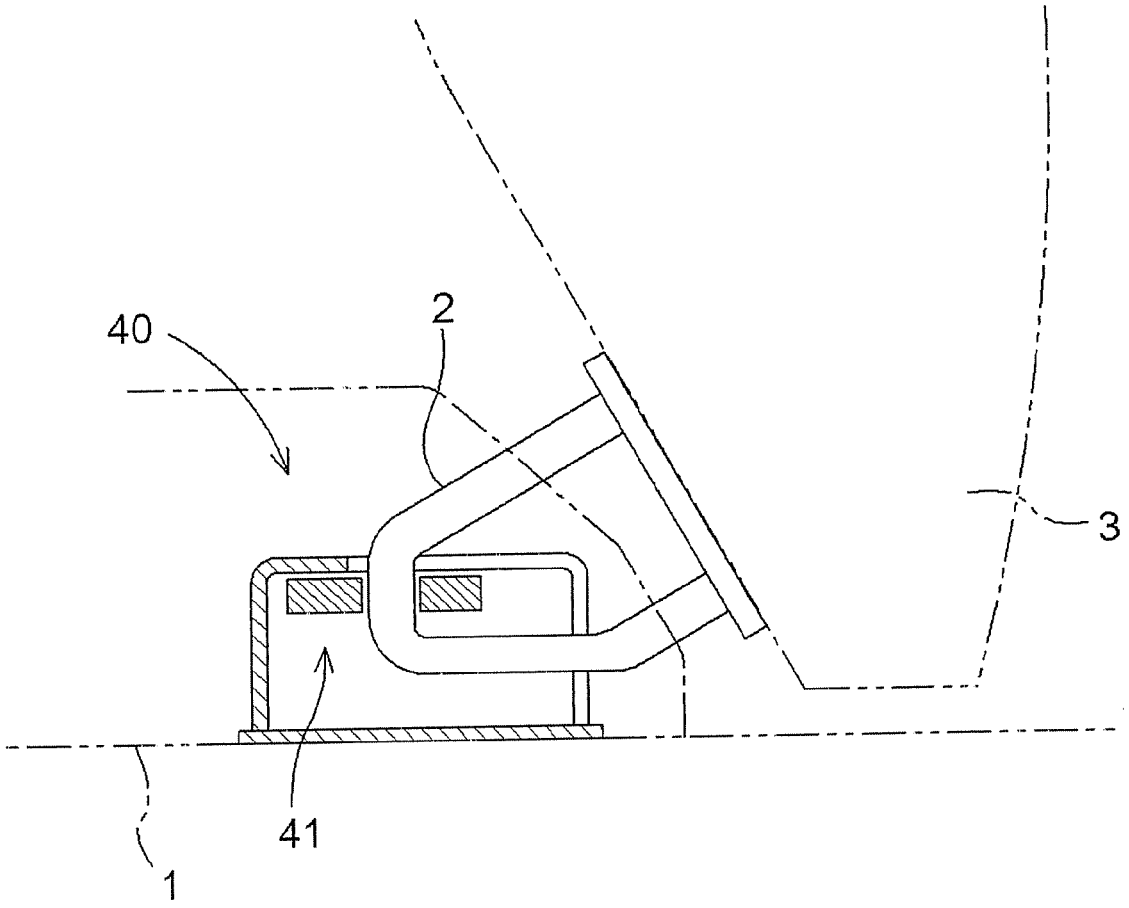
FIG. 2 is a lateral view showing an engaged state of a latch and a striker according to the door opening and closing apparatus shown in FIG. 1.

One embodiment of the present invention will be explained with reference to illustrations of drawing figures as follows. As shown in FIGS. 1 and 2, a door opening and closing apparatus 4 for a vehicle is provided between a vehicle body 1 and a door 3 (e.g., backdoor) of an automobile serving as an example of a vehicle. The door opening and closing apparatus 4 for the vehicle includes a striker 2 which is provided at a side of the door 3 and a door opening and closing operation mechanism 40. An open handle 3*a* is provided at an outer side of the door 3. In this embodiment, an example in which the door opening and closing apparatus 4 is applied to the backdoor is disclosed, however, the application of the door opening and closing apparatus 4 is not limited to the backdoor. For example, the door opening and closing apparatus 4 may be applied to a power slide door, which opens and closes by the sliding movement at a passenger gate provided at a lateral side of the vehicle.

The door opening and closing operation mechanism 40, as shown in FIGS. 3 and 4, performs a locking operation and unlocking operation of the door 3. The door opening and closing apparatus 4 includes a latch 41 shaped in a plate form which is configured to capture the striker 2 to a main body side of the door 3, a pawl 42 restricting a rotation of the latch 41 by a ratchet means, and a latch operation mechanism 50 which operates the latch 41 and the pawl 42. A motor 61 serving as an actuator, a pinion gear 62 and a sector gear (i.e., an example of a displacement body) 63 serving as speed change gears together which changes rotation speed of the motor 61 are provided in order to provide an operational displacement to the latch operation mechanism 50. The sector gear 63 is rotatably supported about a rotational shaft 63*a* arranged at a housing.

The latch 41 is rotatably supported about a supporting shaft 41*a* arranged at the housing and is biased to an original attitude (i.e., an attitude shown in FIG. 3(*a*)) by means of a spring, or the like. The latch 41 includes a first arm portion 411, a second arm portion 412, and an engagement groove portion 413 formed between the first arm portion 411 and the second arm portion 412 and configured to receive, or engage with the striker 2. The first arm portion 411 includes a half-engagement surface which engages with a contact acting portion 421 of the pawl 42 when the latch 41 and the pawl 42 are at a half-latched position. The second arm portion 412 includes a full-engagement surface which engages with the contact acting portion 421 of the pawl 42 when the latch 41 and the pawl 42 are at a fully latched position. The pawl 42 is supported about a supporting shaft 42*a* to be rotatable between an engagement attitude and a disengagement attitude. In a case where the pawl 42 is at the engagement attitude, the contact acting portion (acting piece) 421 of the pawl 42 is positioned within a rotational locus of the first arm portion 411 and the second arm portion 412. In a case where the pawl 41 is at the disengagement attitude, the contact acting portion (acting piece) 421 of the pawl 42 is positioned outside the rotational locus of the first arm portion 411 and the second arm portion 412. The pawl 42 is biased in a direction to return to the engagement attitude by means of a spring.

As a position detector for detecting a rotational position of the latch 41, a half latch switch 81 and a full latch switch 82 which are rotary switches are provided at a detection cylinder which rotates about the supporting shaft 41*a* integrally with the latch 41. The half latch switch 81 detects that the latch 41 is in a half latch region in which the latch 41 is in a half latched state. The full latch switch 82 detects that the latch 41 is in a fill latch region where the latch 41 is in a fully latched state. In this embodiment, the half latch switch 81 switches from High (ON) to Low (OFF) immediately before the latch 41 reaches the half-latched position from the open position. Likewise, the full latch switch 82 switches from High (ON) to Low (OFF) immediately before the latch 41 reaches the fully latched position from the half-latched position.

As a position detector for detecting a rotational position of the pawl 42, a pawl switch 83 which is a rotary switch is provided at a detection cylinder which rotates about the supporting shaft 42*a* integrally with the pawl 42. The pawl switch 83 detects that the pawl 42 is engaged with the latch 41 (i.e., whether the latch 41 and the pawl 42 are in engagement attitude). According to this embodiment, the pawl switch 83 is High (ON) when the pawl 42 is positioned in a region immediately preceding a half-latched position and at the half-latched position where the pawl 42 is engaged with the first arm portion 411 of the latch 41. Further, the pawl switch 83 is High (ON) when the pawl 42 is positioned in a region immediately preceding a fully latched position and at the fully latched position where the pawl 42 is engaged with the second arm portion 412 of the latch 41. Namely, the first dropping point of the pawl switch 83 corresponds to the half-latched position and the second dropping point of the pawl switch 83 corresponds to the fully latched position.

The latch operation mechanism 50 includes a closing operation mechanism 51 and a releasing operation mechanism 52. The closing operation mechanism 51 is configured to have a rotational displacement of the sector gear 63 as an input and a rotational operation thereof relative to the latch 41 as an output. The releasing operation mechanism 52 is configured to have a rotational displacement of the sector gear 63 as an input and a rotational operation (disengaging operation) thereof relative to the pawl 42 as an output. A closing region which is a rotation region of the sector gear 63 when the closing operation mechanism 51 operates differs from a releasing region which is a rotation region of the sector gear 63 when the releasing operation mechanism 52 operates. Further, a neutral region is provided between the closing region and the releasing region. Accordingly, the closing operation mechanism 51 and the releasing operation mechanism 52 are actuated separately.

A first neutral position detecting switch 84 (serving as a first detection portion) and a second neutral position detecting switch 85 (serving as a second detection portion) which are rotary switches which detect rotational displacement attitudes of the sector gear 63 are provided at a detection cylinder which rotates about the rotational shaft 63*a* integrally with the sector gear 63.

Figure 5:
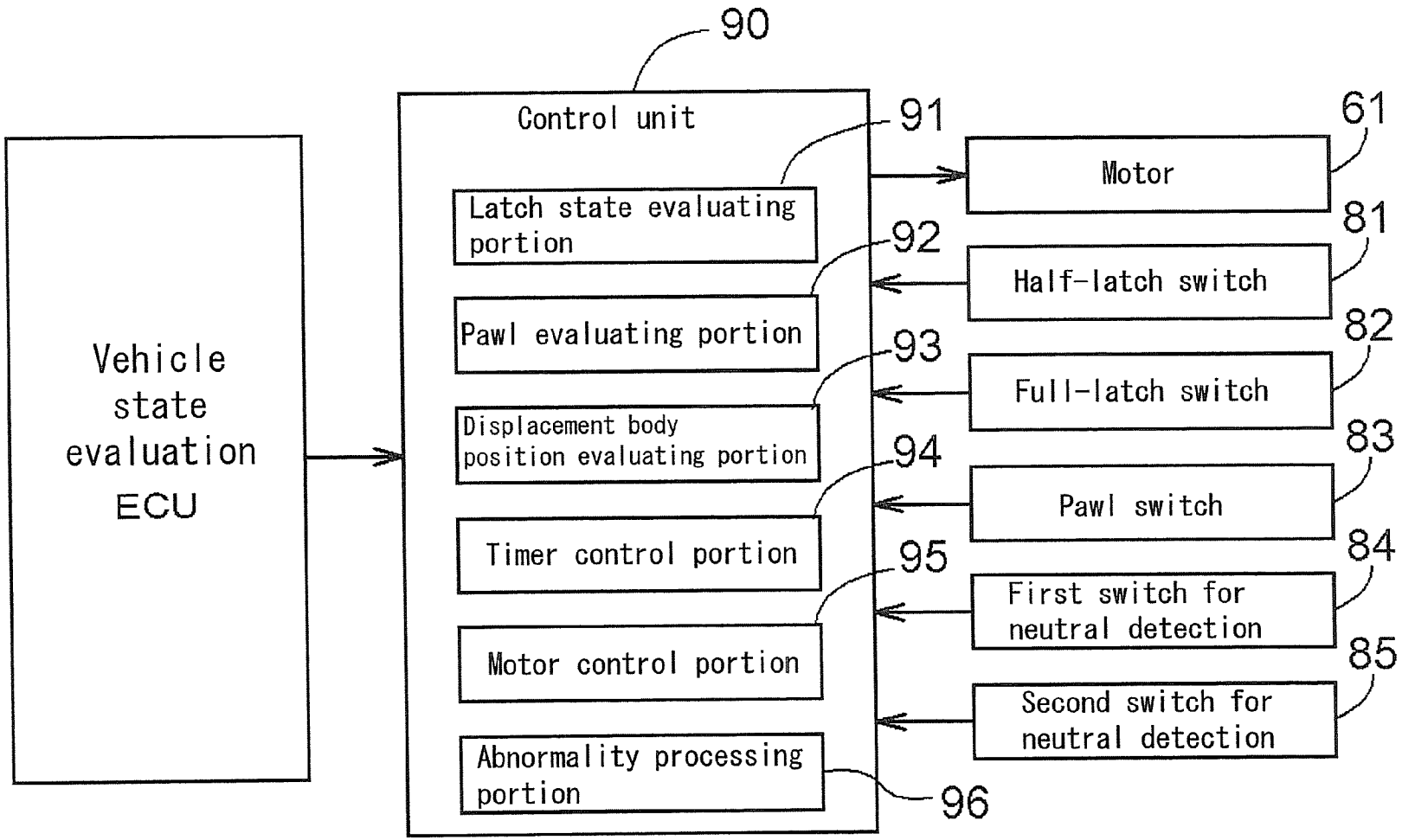
FIG. 5 is a functional block view for a control unit according to the embodiment of the present invention.

A control unit 90 structured with a microcomputer board, shown in FIG. 5, controls the door opening and closing operation mechanism 40. Various switches including a half-latch switch 81, a full-latch switch 82, a pawl switch 83, a first switch 84 for neutral detection, a second switch 85for neutral detection are connected to input ports of the control unit 90, respectively. A motor 62 is connected to an output port of the control unit 90 via a driver. The control unit 90 is connected to a vehicle state evaluating ECU which evaluates a vehicle state and outputs the information of the vehicle state to the control unit 90 so that the control unit 90 receives the vehicle state information with respect to the door opening and closing.

The control unit 90 is configured to produce various control functions for the door opening and close operating mechanism 40 by an installed program. Functions particularly related to the embodiment of the present invention includes a latch state evaluating portion 91, a pawl evaluating portion 92, a displacement body position evaluating portion 93, a timer control portion 94, a motor control portion 95, and an abnormality processing portion 96. The latch state evaluating portion 91 evaluates a state of the latch 41 on the basis of signals from the half-latch switch 81 and the full-latch switch 82. The pawl evaluating portion 92 evaluates a state of the pawl 42 on the basis of a signal from the pawl switch 83. The displacement body position evaluating portion 93 evaluates a rotational position of the sector gear 63 on the basis of a first detection signal from the first switch 84 for neutral detection and a second detection signal from a second switch 85 for neutral detection. The timer control portion 94 performs a timer control using an internal timer, or the like. The motor control portion 95 generates and outputs a control signal to the motor 62 on the basis of evaluation results of the latch state evaluating portion 91, the pawl evaluating portion 92 and the displacement body position evaluating portion 93, and the timer information of the timer control portion 94. The abnormality processing portion 96 executes a recovery in the event that an abnormal state is caused in a control process of the door opening and closing operation mechanism 40.

Figure 6:
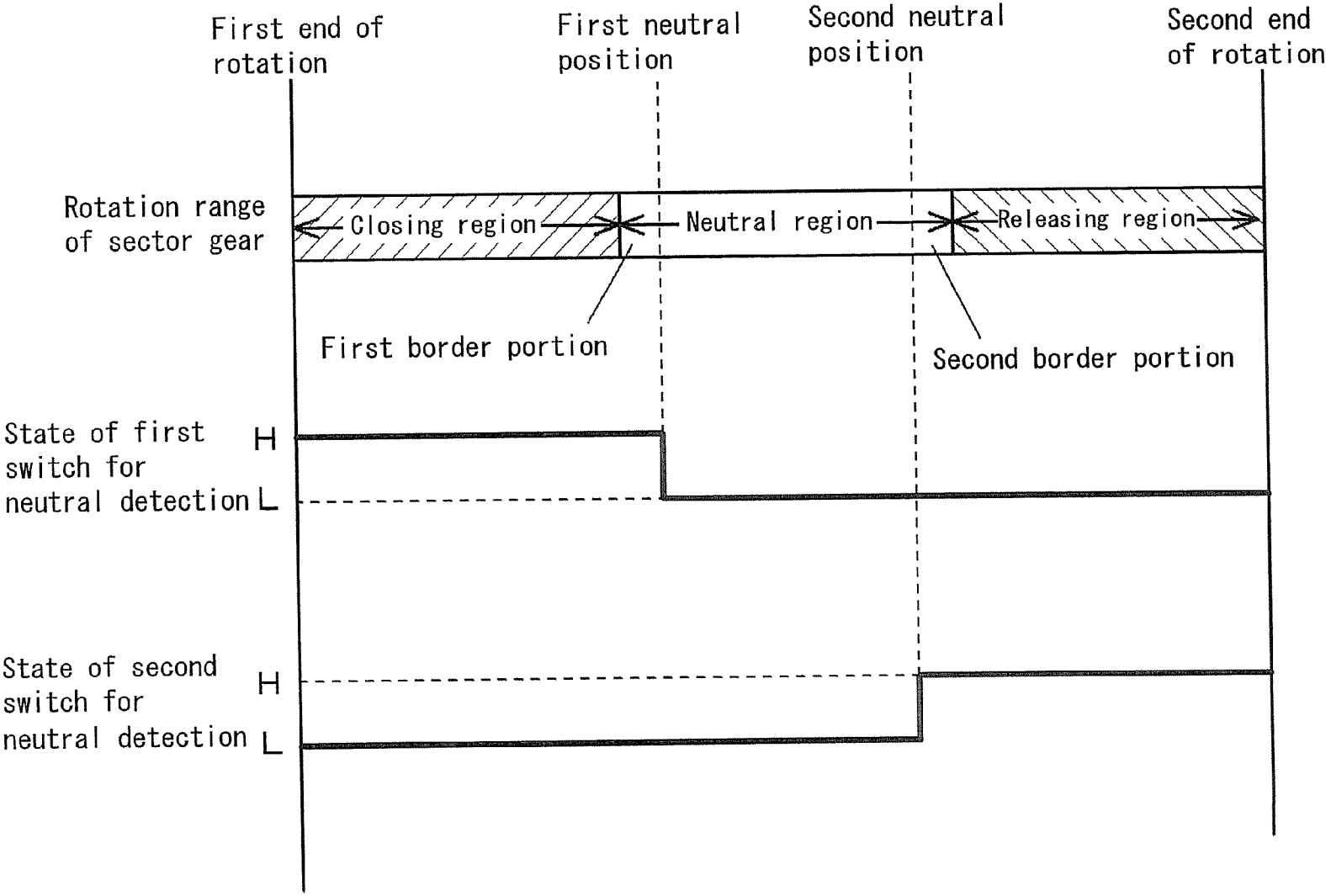
FIG. 6 is an explanatory view showing a rotational region of the sector gear, and states of a first neutral detection switch and a second neutral detection switch according to the embodiment of the present invention.
Figure 7A:
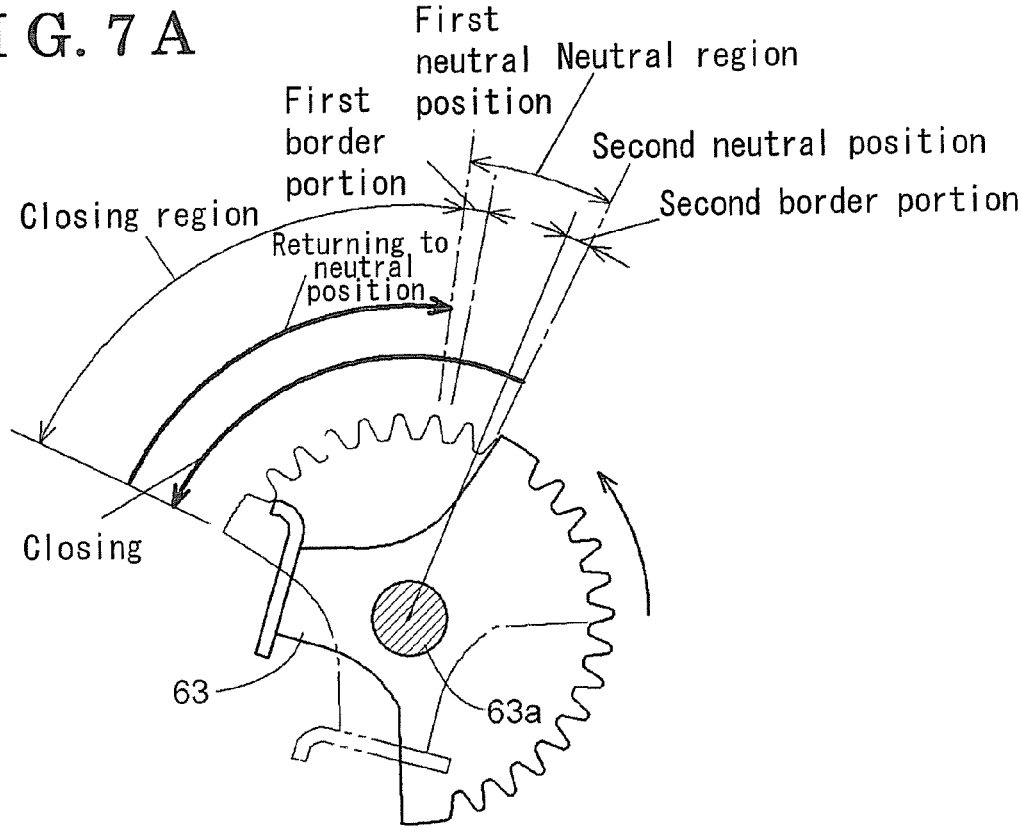
FIGS. 7A and 7B are explanatory views showing movements of the sector gear during the closing operation, the releasing operation and returning operations to neutral positions for the closing operation and the releasing operation, respectively.
Figure 7B:
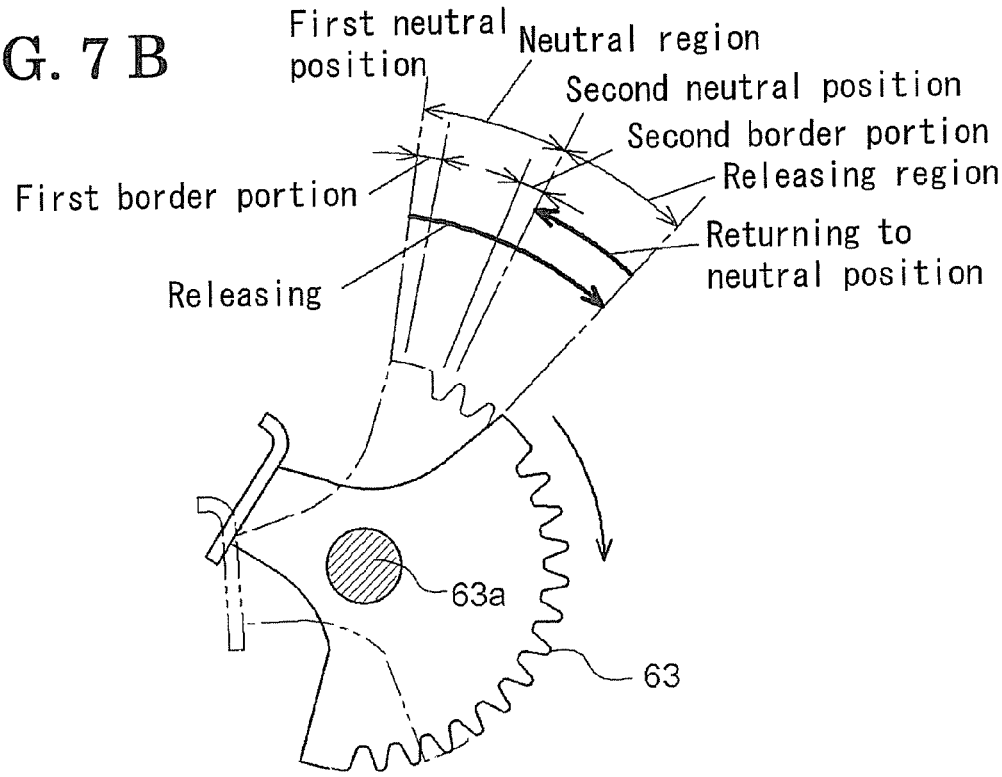

A closing operation in which the striker 2 is captured by, or engaged with the latch 41 is performed by operating the closing operation mechanism 51 via the sector gear 63. A releasing operation in which the striker 2 is released from the latch 41 is performed by operating the releasing operation mechanism 52 via the sector gear 63. A rotation range of the sector gear 63 which introduces the closing operation and the releasing operation is, as shown in FIGS. 6 and 7, divided into a closing region, a releasing region and a neutral region. The neutral region is positioned between the releasing region and the neutral region. A first border portion defined having a predetermined rotational range is provided at a border portion of the neutral region adjacent to the closing region. A second border portion defined having a predetermined rotational range is provided at a border portion of the neutral region adjacent to the releasing region. A border line in the first border portion adjacent to the neutral region is defined as a first neutral position. A border line in the second border portion adjacent to the neutral region is defined as a second neutral position.

Referring to FIG. 6, by the rotation of the sector gear 63 in the closing region towards a first end of rotation which corresponds to a rotation end of the sector gear 63 at the closing region (i.e., counterclockwise rotation in FIG. 7), the closing operation is introduced. Upon the completion of the closing operation, a first returning operation of the sector gear 63 is performed. In the first returning operation, the sector gear 63 rotates in the counter direction from the closing direction (i.e., clockwise direction in FIG. 7A), passes through the closing region and enters the neutral region to stop at the first neutral position. By the rotation of the sector gear 63 in the releasing region towards the second end of rotation (i.e., clockwise direction in FIG. 7B), the releasing operation is introduced. Upon the completion of the releasing operation, a second returning operation of the sector gear 63 is performed. In the second returning operation, the sector gear 63 rotates in the counter direction from the releasing direction (i.e., counterclockwise direction in FIG. 7B), passes through the releasing region and enters the neutral region to stop at the second neutral position.

The first switch 84 for neutral detection includes an electrode surface, which is formed on a peripheral surface of the detection cylinder integrally rotating with the sector gear 63, and a blush, which is configured to contact the electrode surface in a specific rotation range of the sector gear 63. The electrode surface of the first switch 84 for neutral detection is arranged to come in contact with the blush when the rotational position of the sector gear 63 is in the closing region or in the first border portion. Accordingly, as shown in FIG. 6, the first switch 84 for neutral detection outputs High signal as the first detection signal when the rotational position of the sector gear 63 is in the closing region or in the first border portion and outputs Low signal as the first detection signal when the rotational position of the sector gear 63 is other than in the foregoing positions. That is, the first switch 84 for neutral detection is a switching element which switches ON and OFF in accordance with a rotational position of the sector gear 63, and outputs the first detection signal which changes a signal characteristics (e.g., level of electric voltage) by the switching of ON and OFF states when the rotational position of the sector gear 63 passes through the first border portion.

The second switch 85 for neutral detection is structured similarly to the first switch 84 for neutral detection. However, an electrode surface of the second switch 85 arranged to come in contact with a corresponding blush when the rotational position of the sector gear 63 is in the releasing region or in the second border portion. Accordingly, as shown in FIG. 6, the second switch 85 for neutral detection outputs a High signal as the second detection signal when the rotational position of the sector gear 63 is in the releasing region or in the second border portion and outputs a Low signal when the rotational position of the sector gear 63 is in other positions. That is, the second switch 85 for neutral detection is a switching element which switches ON and OFF in accordance with a rotational position of the sector gear 63, and outputs the second detection signal which changes a signal characteristics (e.g., level of electric voltage) by the switching of ON and OFF states when the rotational position of the sector gear 63 passes through the second border portion.

Figures 3A, 3B, 3C, 3D:
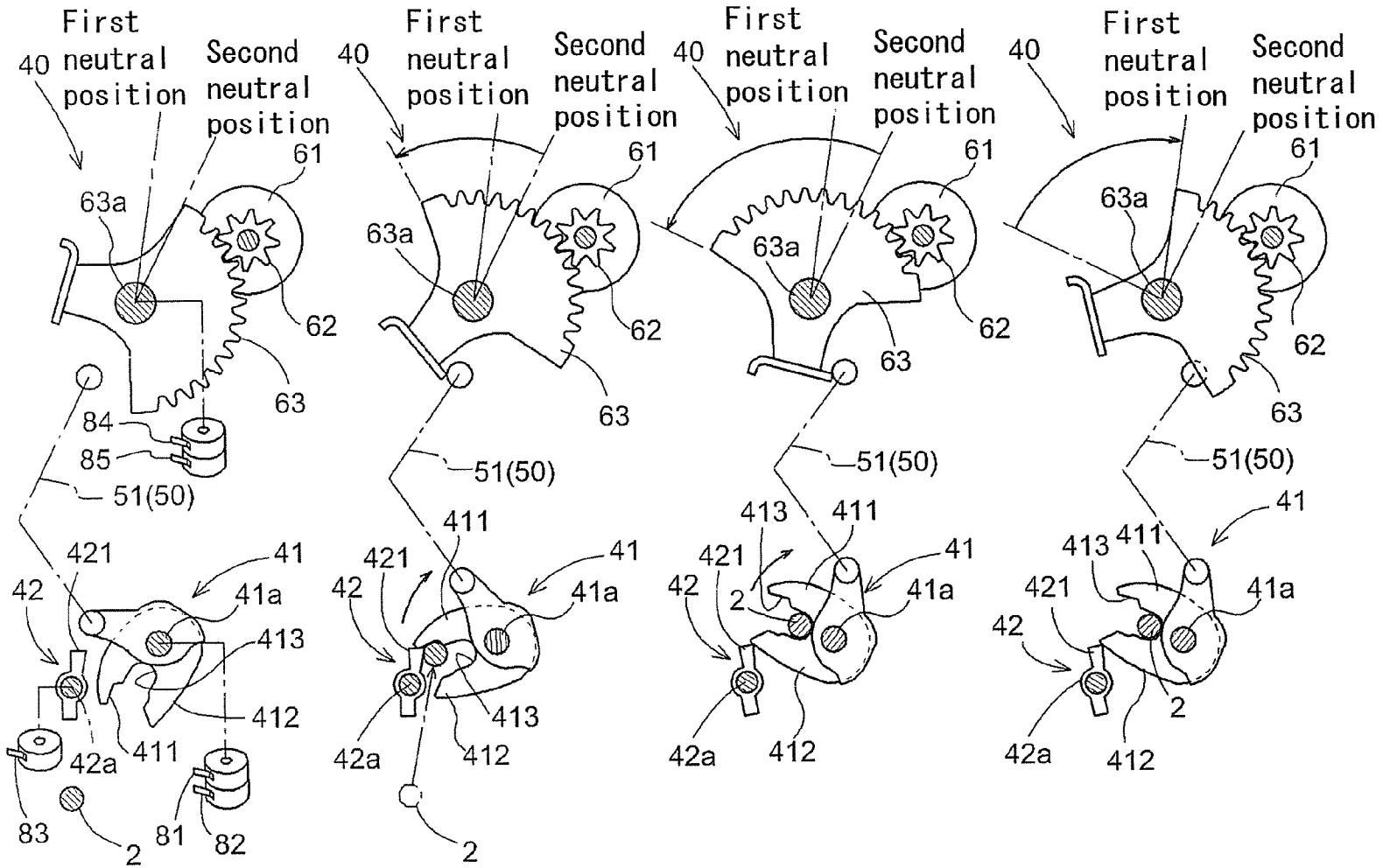
FIGS. 3A-3D are schematic views showing a relationship between a sector gear, the latch and a pawl being in a process of a closing operation according to the embodiment of the present invention.
Figures 4A, 4B, 4C, 4D:
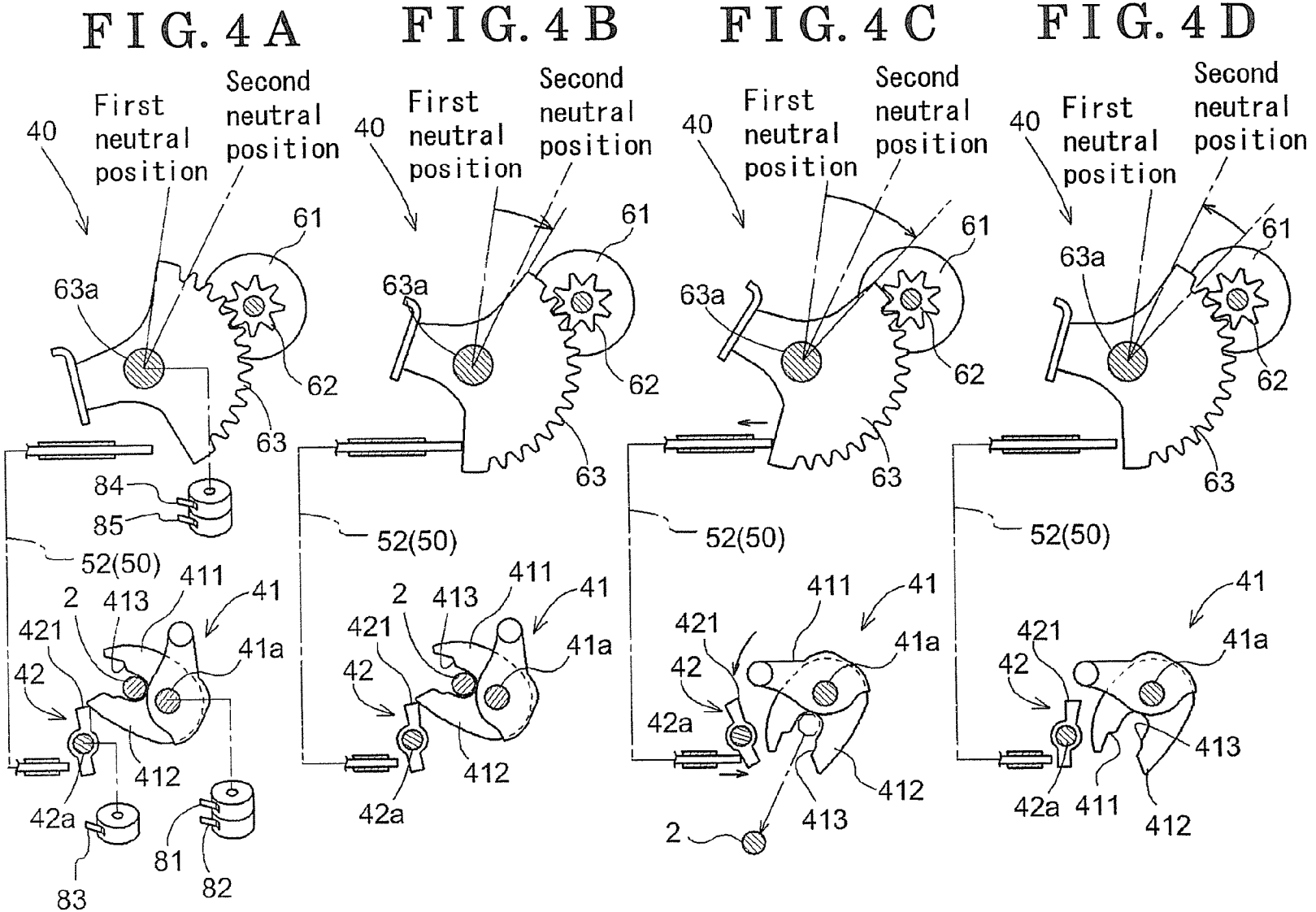
FIGS. 4A-4D are schematic views showing a relationship between the sector gear, the latch and the pawl being in a process of a releasing operation according to the embodiment of the present invention.

Attitudes of the sector gear 63, the latch 41 and the pawl 42 in the closing operation and the releasing operation will be explained with reference to FIGS. 3 and 4 as follows. FIGS. 3A-3D schematically show the closing operation and the operation returning to the neutral position after the completion of the closing operation. FIGS. 4A-4D show the releasing operation and the operation returning to the neutral position after the releasing operation.

The closing operation is performed when closing the door 3 relative to the vehicle body 1. When the door 3 is in an open state, the rotational position of the sector gear 63 is at the second neutral position (shown in FIG. 3A) by the returning operation to the neutral position performed after the preceding releasing operation. When the door 3, which is in an open state, is moved in the closing direction, the door opening and closing operation mechanism 40 arranged at the door 3 approaches the striker 2 fixed to the vehicle body 1. Thereafter, first, the engagement groove portion 413 of the latch 41 at the door opening and closing operation mechanism 40 receives the striker 2. Upon further movement of the door 3 in the closing direction, the contact acting portion 421 of the pawl 42 comes to be engaged with the first arm portion 411 of the latch 41 (i.e., a half-latched position). Immediately before the latch 41 reaches the half-latched position, the motor 61 actuates to rotate in a normal direction thus to rotate the sector gear 63. As shown in FIG. 3B, upon the rotation of the sector gear 63, the closing operation mechanism 51 is operated to rotate the latch 41 by the motor drive force. At this stage, the door 3 is not completely closed relative to the vehicle body 1. As shown in FIG. 3C, when the sector gear 63 further rotates to the rotation end position of the closing region, the contact acting portion 421 of the pawl 42 is engaged with the second arm portion 412 of the latch 41 (i.e., fully latched position). At this stage, the door 3 is completely closed relative to the vehicle body 1.

Upon the completion of the closing operation, the motor 61 actuates to rotate in a reverse direction so as to return the sector gear 63 to the neutral position. When the rotational position of the sector gear 63 reaches the first neutral position and the signal from the first switch 85 for neutral detection is switched from High to Low, the operation of the sector gear 63 is stopped (see FIG. 3D).

The releasing operation is performed when opening the door 3 which is closed relative to the vehicle body 1. When the door 3 is in a closed state, the rotational position of the sector gear 63 is at the first neutral position shown in FIG. 4A by the returning operation to the neutral position performed after the closing operation. When the motor 61 actuates to rotate in the reverse direction by an operation of, for example, a switch provided at the open handle 3*a* of the door 3, the sector gear 63 rotates towards releasing region (see FIG. 4B). Upon the rotation of the sector gear 63, the releasing operation mechanism 52 is cooperated to rotate the pawl 42 in a disengaging direction. When the contact acting portion 421 of the pawl 42 is disengaged from the latch 41, the pawl 42 returns to an initial position exhibiting a disengaged attitude by means of a biasing force of a spring (see FIG. 4C). The latch 41 returns to an attitude to release the striker 2 by a biasing force of a spring. At this stage, the door 3 assumes openable relative to the vehicle body 1.

Upon the completion of the releasing operation, the motor 61 is actuated to rotate in a normal direction in order to return the sector gear 63 to the neutral position. When the rotational position of the sector gear 63 reaches the second neutral position and a signal from the second switch 85 for neutral detection is switched from High to Low, the operation of the sector gear 63 is stopped (see FIG. 4D).

Figure 8:
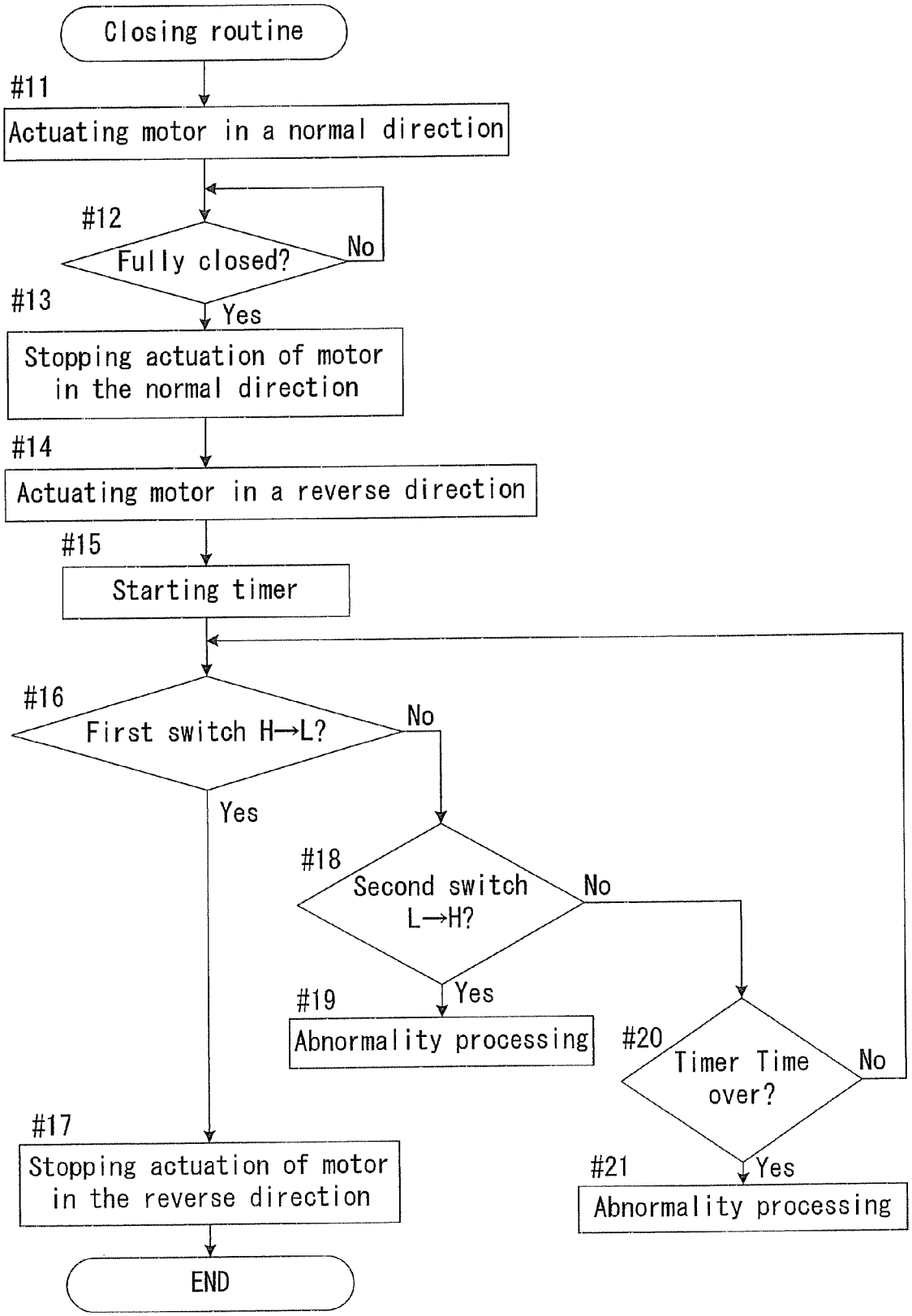
FIG. 8 is a flowchart showing a routine for the closing operation.
Figure 9:
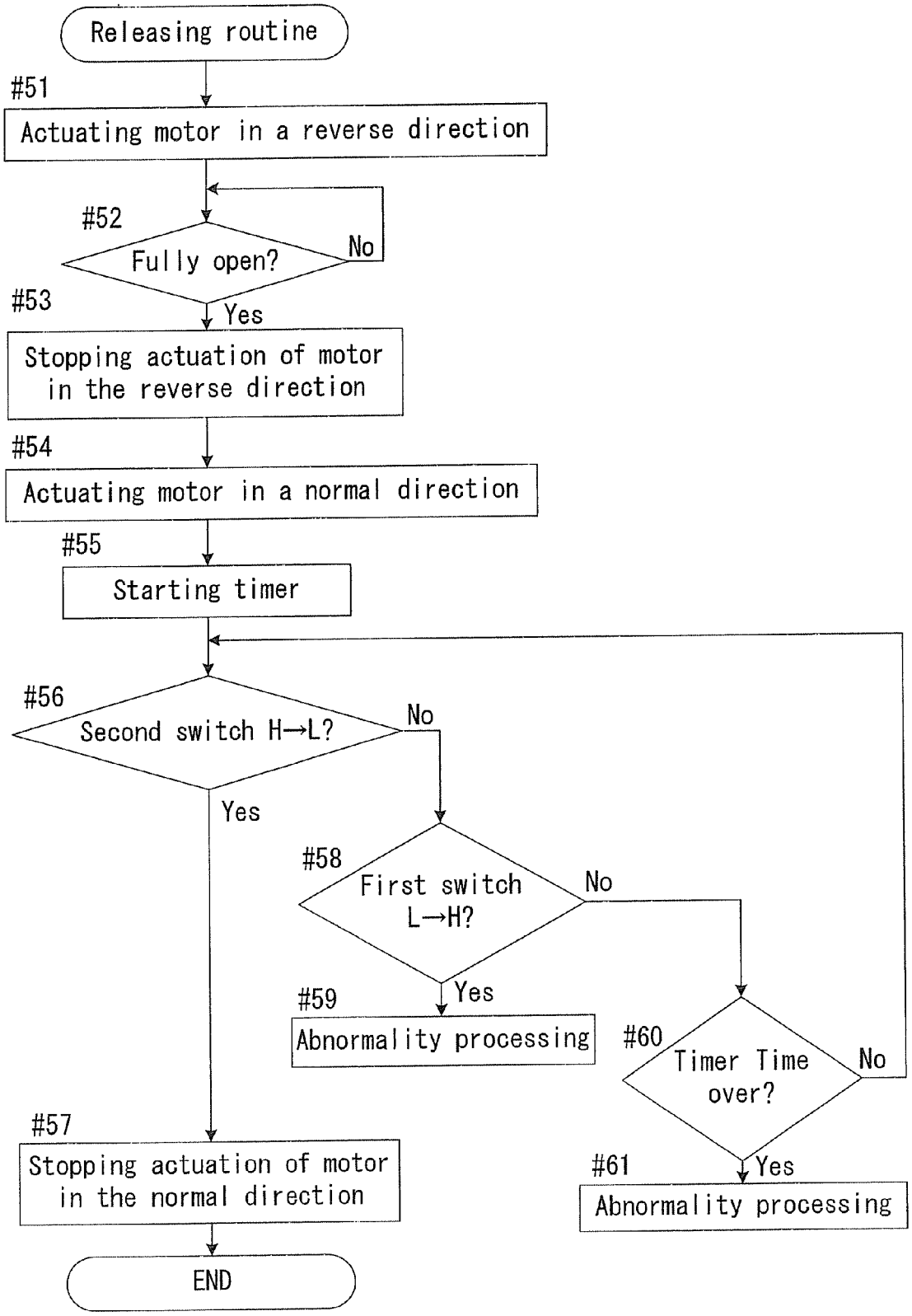
FIG. 9 is a flowchart showing a routine for the releasing operation.

Flows of the closing operation and the releasing operation explained above will be explained hereinafter referring to FIGS. 8 and 9.

In the closing operation of the door 3, the striker 2 enters into the engagement groove portion 413 of the latch 41 to rotate the latch 41. When the latch 41 further rotates and the half latch switch 81 is switched from High to Low) the closing operation starts by the actuation of the motor 61 in the normal direction (Step #11). The rotation of the latch 41 by the motor drive force continues until the latch 41 completely captures the striker 2 to be the fully latched position (Step #12). When the latch 41 comes to be fully latched (i.e., door fully closed) (i.e., Yes at Step #12), the actuation of the motor 61 is stopped (Step #13).

Next, the operation to return the sector gear 63 from the closing region to the first neutral position via the neutral region is performed. In the returning operation of the sector gear to the neutral position, first, the motor 61 is actuated to rotate in the reverse direction so that the sector gear 63 rotates towards the neutral region (Step #14). Simultaneously, an internal timer functioning as a preliminary fail safe operation is started to time the first setting time (Step #15). In the next step, whether the state of the first switch 84 for neutral detection is switched from High to Low is checked (Step #16). In this case, because the returning operation of the sector gear 63 to the neutral position is performed after the latch 41 is fully latched (i.e., fully latched position), the first switch 84 for neutral detection is in High state (see FIG. 6) in a normal condition The first neutral position is determined as a returning point to a neutral state from the closing region of the sector gear 63, the actuation of the motor 61 is stopped when the state of the first switch 84 for neutral detection is switched from High to Low (Step #17).

In the event that the state of the first switch 84 for neutral detection is still High at Step #16 (i.e., No at Step #16), whether the second switch 85 for neutral detection is switched from Low to High is checked in Step #18. Because the rotational position of the sector gear 63 is at the releasing region side relative to the first neutral position, the second switch 85 for neutral detection assume High when the rotational position of the sector gear 63 crosses over the second neutral position (FIG. 6). Accordingly, in a normally operated state, the first switch 84 for neutral detection should switch from High to Low before the second switch 85 for neutral detection is switched from Low to High. However, in case the first switch 84 for neutral detection malfunctions because of a failure or the like, the abnormality that the switching of the first switch 84 for neutral detection from High to Low is not observed even when the sector gear 63 advances exceeding the first neutral position may be caused. In the event of the abnormality such as the foregoing conditions, the switching of the second switch 85 for neutral detection from Low to High is judged when the sector gear 63 reaches the second neutral position. When the switching of the second switch 85 for neutral detection from Low to High is judged (Yes at Step #18), an abnormality processing which confirms the generation of the abnormal state is executed (Step #19), and the actuation of the motor 61 is stopped (Step #17). By entering the malfunction information of the first switch 84 for neutral detection in a list at the abnormality processing, the information can be informed to a driver as necessity arises. In those circumstances, the abnormality processing may be executed after stopping the actuation of tie motor 61. Thus, Step #18 serves as a fail-safe function of the first switch 84 for neutral detection using the second switch 85 for neutral detection.

In the event that the second switch 85 for neutral detection is still Low state at Step #18 (i.e., No at Step #18), whether or not the time for the internal timer is up is checked (Step #20). According to this embodiment, the first setting time for the internal timer is determined as a duration of time that the sector gear 63 reaches the second neutral position predicting the lowest speed of a speed fluctuation range of the motor 61. Accordingly, in the event that the motor 61 actuates at high speed side of the speed fluctuation range, the time for the internal timer is up after the sector gear 63 enters the releasing region. Consequently, the motor-stop operation based on the internal timer functions as a preliminary fail safe. When the time of the internal timer is up (Yes at Step #20), an abnormality processing is executed (Step #21), and the actuation of the motor 61 is stopped (Step #17). In the foregoing state, the abnormality processing is an emergency processing. Because there is a concern that the door 3 may become a half-open state, it is preferable to inform the information to the driver immediately. In the event that the time of the internal timer is not up (No at Step #20), the transaction returns to Step #16 to continue the returning operation of the sector gear to the neutral position.

When opening the door 3, the releasing operation starts in response to an operation of a switch, or the like, and the motor 61 actuates to rotate in the reverse direction (Step #51). The rotation of the pawl 42 by the motor drive force continues until the pawl 42 and the latch 41 are disengaged (Step #52). When the latch 41 and the pawl 42 are disengaged and the latch 41 returns to an attitude to release the striker 2 (i.e., fully open) so that the door 3 is openable (Yes at Step #52), the actuation of the motor 61 is stopped (Step #53).

Next, the operation to return the sector gear 63 from the releasing region to the neutral region, in this case, to the second neutral position is performed. In the returning operation of the sector gear 63 to the neutral position, first, the motor 61 is actuated to rotate in the normal direction so that the sector gear 63 rotated towards the neutral region (Step #54). Simultaneously, an internal timer functioning as a preliminary fail-safe operation is started to time a second setting time (Step #55). In the next step, whether the state of the second switch 85 for neutral detection is switched from High to Low is checked (Step #56). In this case, because the returning operation of the sector gear 63 to the neutral position is performed after the latch 41 is unlatched to release the striker 2, the second switch 85 for neutral detection is in High state (see FIG. 6) in a normal condition The second neutral position is determined as a returning point to a neutral state from the releasing region of the sector gear 63, the actuation of the motor 61 is stopped when the state of the second switch 85 for neutral detection is switched from High to Low (Step #57).

In the event that the state of the second switch 85 for neutral detection is still High at Step #56 (i.e., No at Step #56), whether the first switch 84 for neutral detection is switched from Low to High is checked in Step #58. Because the rotational position of the sector gear 63 is at the closing region side in the neutral region relative to the second neutral position, the first switch 84 for neutral detection assumes High state after the sector gear 63 reaches the region crossing over the first neutral position (see FIG. 6). Accordingly, in a normally operated state, the second switch 85 for neutral detection should switch from High to Low before the first switch 84 for neutral detection is switched from Low to High. However, in case the second switch 85 for neutral detection malfunctions because of a failure or the like, the abnormality that the switching of the second switch 85 for neutral detection from High to Low is not observed even when the sector gear 63 advances exceeding the second neutral position may be caused. In the event of the abnormality such as the foregoing conditions, the switching of the first switch 84 for neutral detection from Low to High is judged when the sector gear 63 reaches the first neutral position. When the switching of the first switch 84 for neutral detection from Low to High is judged (Yes at Step #58), an abnormality processing which confirms the generation of the abnormal state is executed (Step #59), and the actuation of the motor 61 is stopped (Step #57). By entering the malfunction information of the second switch 85 for neutral detection in a list at the abnormality processing, the information can be informed to the driver as necessity arises. In those circumstances, the abnormality processing may be executed after stopping the actuation of the motor 61. Thus, the transaction of Step #58 serves as a fail-safe function of the second switch 85 for neutral detection using the first switch 84 for neutral detection.

In the event that the first switch 84 for neutral detection is still Low state at Step #58 (i.e., No at Step #58), whether or not the time for the internal timer is up is checked (Step #60). According to this embodiment, the second setting time for the internal timer is determined as a duration of time that the sector gear 63 reaches the first neutral position predicting the lowest speed of a speed fluctuation range of the motor 61. Accordingly, in the event that the motor 61 actuates at high speed side of the speed fluctuation range, the time for the internal timer is up after the sector gear 63 enters the closing region. Consequently, the motor-stop operation based on the internal timer functions as a preliminary fail safe. When the time of the internal timer is up (Yes at Step #60), an abnormality processing is executed (Step #61), and the actuation of the motor 61 is stopped (Step #57). In the foregoing state, the abnormality processing is an emergency processing. Because there is a concern that the door 3 may be re-latched, it is preferable to inform the information to the driver mediately. In the event that the time of the internal timer is not up (No at Step #60), the transaction returns to Step #56 to continue the returning operation of the sector gear to the neutral position.

In the foregoing example of the embodiment, a timer control using the internal timer is intended to be applied as a last measures when both of the first switch 84 for neutral detection and the second switch 85 for neutral detection malfunction. Instead of the foregoing structure, in a closing routine, under the condition setting the first setting time and the second setting time shorter, the timer control may be applied as a fail safe for the first switch 84 for neutral detection and a detection using the second switch 85 for neutral detection may be applied as a last measure. In those circumstances, in a releasing routine, the timer control may be applied as a fail safe for the second switch 85 for neutral detection and a detection using the first switch 84 for neutral detection may be applied as a last measure. Further, roles of the timer control may be changed in the closing routine from the releasing routine. In addition, the timer control may not be necessarily applied.

Generally, it is necessary to consider a time lag from the state changes of the first switch 84 for neutral detection and the second switch 85 for neutral detection to a halt of the motor actuation and the sector gear 63 thereafter. In order to absorb the above mentioned time lag, the border line of the first border portion having a predetermined rotational range and being closer to a center of the neutral region is defined as the first neutral position and the border line of the second border portion having a predetermined rotational range and being closer to the center of the neutral region is defined as the second neutral position. Namely, the ranges (widths) of the first border portion and the second border portion are determined in accordance with the time lag. In a case where the time lag can be substantially disregarded, the first border portion may correspond to a borderline between the neutral region and the closing region and the second border portion may correspond to a borderline between the neutral region and the releasing region.

According to the embodiment explained above, the sector gear 63 rotating about the rotational support shaft 63*a* is applied as the displacement body, a moving body which reciprocates may be applied as the displacement body instead of the rotational body. In those circumstances, a linear motor or a solenoid may be applied as an actuator.

Further, according to the embodiment examined above, the door opening and closing operation mechanism 40 having the latch 41 is provided at the door 3 and the striker 2 is provided at the vehicle body 1. However, the construction is not limited to the foregoing structure, and the door opening and closing operation mechanism 40 may be provided at the vehicle body 1 and the striker 2 may be provided at the door 3.

According to the embodiment of the present invention, in the returning operation of the sector gear 63 after the closing operation to latch the door is performed, in a normal condition, the sector gear 63 halts at the border between the neutral region and the closing region by a detection of the first border portion by means of the first switch 84 for neutral detection. In the event that the malfunction of the first switch 84 for neutral detection is generated, the sector gear 63 cannot stop at the first border portion, however, stops at the border between the neutral region and the releasing region by the detection of the second border portion by means of the second switch 85 for neutral detection. Further, in the returning operation of the sector gear 63 after the releasing operation to unlatch the door is performed, in a normal condition, the sector gear 63 halts at the border between the neutral region and the releasing region by a detection of the second border portion by means of the second switch 85 for neutral detection. In the event that the malfunction of the second switch 85 for neutral detection is generated, the sector gear 63 cannot stop at the second border portion, however, stops at the border between the neutral region and the closing region by the detection of the first border portion by means of the first switch 84 for neutral detection. Accordingly, during the returning operation of the sector gear 63 after closing operation, the second switch 85 for neutral detection serves as a fail safe for the first switch 84 for neutral detection. In the returning operation of the sector gear 63 after releasing operation, the first switch 84 for neutral detection serves as a fail safe for the second switch 85 for neutral detection.

According to the door opening and closing apparatus 4 of the embodiment, the first border portion and the second border portion include a predetermined displacement range, and the first detection portion and the second detection portion are configured to change the first detection signal and the second detection signal, respectively, when the sector gear 63 passes through a respective border line of the corresponding displacement range positioned closer to a center of the neutral region.

According to the embodiment of the present invention, in the returning operation of the sector gear 63 after closing operation, in a normal condition, the sector gear 63 halts at the border line within the neutral region closer to the closing region by the predetermined range (width). In the event that the malfunction of the first switch 84 for neutral detection is generated, the sector gear 63 stops at the border line within the neutral region closer to the releasing region by the predetermined displacement range (width). Further, in the returning operation of the sector gear 63 after the releasing operation, in a normal condition, the sector gear 63 halts at the displacement position within the neutral region close to the releasing region In the event that the second switch 85 for neutral detection malfunctions, the sector gear 63 stops at the border line within the neutral region closer to the closing region by the predetermined displacement range (width). Namely, the predetermined displacement range (width) can absorb the time lag of the motor 61 based on a response of the first switch 84 for neutral detection and the second switch 85 for neutral detection serving as a fail safe function. In consequence, highly reliable fail safe can be achieved even if the level of the control for halting the motor 61 based on the response of the first switch 84 for neutral detection and the second switch 85 for neutral detection is not highly precise.

According to another aspect of the door opening and closing apparatus 4 of the embodiment, the first switch 84 for neutral detection and the second switch 85 for neutral detection include switching elements, respectively. The first switch 84 for neutral detection outputs the first detection signal changed by a switching of ON and OFF states when the sector gear 63 passes through the first border portion of the neutral region closer to the closing region. The second switch 85 for neutral detection outputs the second detection signal changed by the switching of ON and OFF states when the the sector gear 63 passes through the second border portion of the neutral region closer to the releasing region According to further aspect of the embodiment, the first switch 84 for neutral detection outputs one of High signal and Low signal as the first detection signal when the sector gear 63 is in the closing region or the first border portion and outputs the other of the High signal and the Low signal when sector gear 63 is in the neutral region other than the first border portion or the releasing region. And the second switch 85 for neutral detection outputs one of High signal and Low signal as the second detection signal when the sector gear 63 is in the releasing region or the second border portion and outputs the other of the High signal and the Low signal when the sector gear 63 is in the neutral region other than the second border portion or the closing region.

According to the embodiment of the present invention, the detection portion (i.e., either first switch 84 for neutral detection or the second switch 85 for neutral detection) which detects the particular displacement position of the sector gear 63 at the closing operation and its detecting signal and the detection portion (i.e., either the second switch 85 for neutral detection or the first switch 84 for neutral detection) which detects the particular displacement position of the sector gear 63 at the releasing operation and its detecting signal are completely independent from one another. Accordingly, the first switch 84 for neutral detection and the second switch 85 for neutral detection can serve as fail safe function for one another in a state being fully independent from one another.

According to still another aspect of the embodiment, the control unit 60 includes a timer control portion 94 serving as a backup of the first switch 84 for neutral detection and the second switch 85 for neutral detection.

According to the embodiment of the present invention, even when both of the first switch 84 for neutral detection and the second switch 85 for neutral detection malfunction, the motor 61 is compulsorily deactuated based on the timer control when a predetermined time has elapsed. Further, the abnormal state can be informed to the driver based on the timer control.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A door opening and closing apparatus for a vehicle, comprising:

a latch configured to engage with and disengaged from a striker;

a displacement body operating the latch via a latch operation mechanism and being displaced within a moving region including a closing region in which the latch is engaged with the striker, a releasing region in which the latch is disengaged from the striker and a neutral region positioned between the closing region and the releasing region, the displacement body displacing by means of a drive force of an actuator for selectively engaging and disengaging the latch and the striker;

a first detection switch outputting a first detection signal changed when the displacement body passes through a first border portion of the neutral region closer to the closing region, the first border portion being positioned between the closing region and the neutral region;

a second detection switch outputting a second detection signal changed when the displacement body passes through a second border portion of the neutral region closer to the releasing region, the second border portion being positioned between the releasing region and the neutral region; and a control unit connected to the first detection switch and the second detection switch, and controls a moving position of the displacement body based on the first detection signal and the second detection signal.

2. The door opening and closing apparatus for a vehicle according to claim 1, wherein the first border portion and the second border portion include a predetermined displacement range, and the first detection switch and the second detection switch are configured to change the first detection signal and the second detection signal, respectively, when the displacement body passes through a respective border line of the corresponding displacement range positioned closer to a center of the neutral region.

3. The door opening and closing apparatus for a vehicle according to claim 1, wherein the first detection switch and the second detection switch include switching elements, respectively;

the first detection switch outputs the first detection signal changed by a switching of ON and OFF states when the displacement body passes through the first border portion of the neutral region closer to the closing region; and the second detection switch outputs the second detection signal changed by the switching of ON and OFF states when the displacement body passes through the second border portion of the neutral region closer to the releasing region.

4. The door opening and closing apparatus for a vehicle according to claim 2, wherein the first detection switch and the second detection switch include switching elements, respectively;

the first detection switch outputs the first detection signal changed by a switching of ON and OFF states when the displacement body passes through the first border portion of the neutral region closer to the closing region; and the second detection switch outputs the second detection signal changed by the switching of ON and OFF states when the displacement body passes through the second border portion of the neutral region closer to the releasing region.

5. The door opening and closing apparatus for the vehicle according to claim 1, wherein the first detection switch outputs one of High signal and Low signal as the first detection signal when the displacement body is in the closing region or the first border portion and outputs the other of the High signal and the Low signal when the displacement body is in the neutral region other than the first border portion or the releasing region; and the second detection switch outputs one of High signal and Low signal as the second detection signal when the displacement body is in the releasing region or the second border portion and outputs the other of the High signal and the Low signal when the displacement body is in the neutral region other than the second border portion or the closing region.

6. The door opening and closing apparatus for the vehicle according to claim 2, wherein the first detection switch outputs one of High signal and Low signal as the first detection signal when the displacement body is in the closing region or the first border portion and outputs the other of the High signal and the Low signal when the displacement body is in the neutral region other than the first border portion or the releasing region; and the second detection switch outputs one of High signal and Low signal as the second detection signal when the displacement body is in the releasing region or the second border portion and outputs the other of the High signal and the Low signal when the displacement body is in the neutral region other than the second border portion or the closing region.

7. The door opening and closing apparatus for the vehicle according to claim 3, wherein the first detection switch outputs one of High signal and Low signal as the first detection signal when the displacement body is in the closing region or the first border portion and outputs the other of the High signal and the Low signal when the displacement body is in the neutral region other than the first border portion or the releasing region; and the second detection switch outputs one of High signal and Low signal as the second detection signal when the displacement body is in the releasing region or the second border portion and outputs the other of the High signal and the Low signal when the displacement body is in the neutral region other than the second border portion or the closing region.

8. The door opening and closing apparatus for the vehicle according to claim 4, wherein the first detection switch outputs one of High signal and Low signal as the first detection signal when the displacement body is in the closing region or the first border portion and outputs the other of the High signal and the Low signal when the displacement body is in the neutral region other than the first border portion or the releasing region; and the second detection switch outputs one of High signal and Low signal as the second detection signal when the displacement body is in the releasing region or the second border portion and outputs the other of the High signal and the Low signal when the displacement body is in the neutral region other than the second border portion or the closing region.

9. The door opening and closing apparatus for the vehicle according to claim 1, wherein the control unit includes a timer control portion serving as a backup of the first detection switch and the second detection switch.

10. The door opening and closing apparatus for the vehicle according to claim 2, wherein the control unit includes a timer control portion serving as a backup of the first detection switch and the second detection switch.

11. The door opening and closing apparatus for the vehicle according to claim 3, wherein the control unit includes a timer control portion serving as a backup of the first detection switch and the second detection switch.

12. The door opening and closing apparatus for the vehicle according to claim 4, wherein the control unit includes a timer control portion serving as a backup of the first detection switch and the second detection switch.

13. The door opening and closing apparatus for the vehicle according to claim 5, wherein the control unit includes a timer control portion serving as a backup of the first detection switch and the second detection switch.

14. The door opening and closing apparatus for the vehicle according to claim 6, wherein the control unit includes a timer control portion serving as a backup of the first detection switch and the second detection switch.

15. The door opening and closing apparatus for the vehicle according to claim 7, wherein the control unit includes a timer control portion serving as a backup of the first detection switch and the second detection switch.

16. The door opening and closing apparatus for the vehicle according to claim 8, wherein the control unit includes a timer control portion serving as a backup of the first detection switch and the second detection switch.

17. The door opening and closing apparatus for the vehicle according to claim 7, wherein the control unit includes a timer control portion serving as a backup of the first detection switch and the second detection switch.

18. The door opening and closing apparatus for the vehicle according to claim 8, wherein the control unit includes a timer control portion serving as a backup of the first detection switch and the second detection switch.

19. The door opening and closing apparatus for the vehicle according to claim 1, during a returning operation of the displacement body after a closing operation of the displacement body in which the latch is engaged with the striker, the displacement body halts at the first border portion when the first detection switch outputs the first detection signal, and if malfunction of a neutral detection occurs by virtue of the first detection switch failing to output the first detection signal, the displacement body stops at the second border portion when the second detection switch outputs the second detection signal.

20. The door opening and closing apparatus for the vehicle according to claim 1, wherein the first detection switch comprises a first switch that transmits the first detection signal to the control unit when the displacement body moves to a position within the first border portion from a position outside the first border portion.

21. The door opening and closing apparatus for the vehicle according to claim 18, wherein the second detection switch comprises a second switch that transmits the second detection signal to the control unit when the displacement body moves to a position within the second border portion from a position outside the second border portion.

* * * * *